US005400066A

United States Patent [19]

Matsumoto et al.

[11] Patent Number: 5,400,066

[45] Date of Patent: Mar. 21, 1995

[54] INK TANK CARTRIDGE THAT PREVENTS LEAKAGE OF RESIDUAL INK AND INK JET RECORDING APPARATUS USING SAME

[75] Inventors: Haruyuki Matsumoto, Yokohama; Toshihiko Ujita, Yamato, both of Japan

[73] Assignee: Canon Kabushiki Kaisha, Tokyo, Japan

[21] Appl. No.: 275,252

[22] Filed: Jul. 15, 1994

Related U.S. Application Data

[63] Continuation of Ser. No. 801,936, Dec. 3, 1991, abandoned.

[30] Foreign Application Priority Data

Dec. 10, 1990 [JP] Japan ..... 2-409959

[51] Int. Cl.[6] ..... B41J 2/175

[52] U.S. Cl. ..... 347/86; 347/84; 355/260

[58] Field of Search ..... 347/84, 85, 86; 355/260; 222/DIG. 1

[56] References Cited

U.S. PATENT DOCUMENTS

| | | | |
|---|---|---|---|
| 4,253,103 | 2/1981 | Heinzl et al. | 346/140 R |
| 4,313,124 | 1/1982 | Hara | 346/140 R |
| 4,345,262 | 8/1982 | Shirato et al. | 346/140 R |
| 4,432,005 | 2/1984 | Duffield et al. | 346/140 R |
| 4,437,104 | 3/1984 | Hudson | 346/140 R |
| 4,447,820 | 5/1984 | Terasawa | 346/140 R |
| 4,459,600 | 7/1984 | Sato et al. | 346/140 R |
| 4,463,359 | 7/1984 | Ayata et al. | 346/1.1 |
| 4,558,326 | 12/1985 | Kimura et al. | 346/1.1 |
| 4,558,333 | 12/1985 | Sugitani et al. | 346/140 R |
| 4,723,129 | 2/1988 | Endo et al. | 346/1.1 |
| 4,740,796 | 4/1988 | Endo et al. | 346/1.1 |
| 4,751,533 | 6/1988 | Saito et al. | 346/140 R |
| 4,760,409 | 7/1988 | Kiyohara et al. | 346/140 R |
| 4,766,457 | 8/1988 | Barker et al. | 355/260 |
| 5,075,727 | 12/1991 | Nakatomi | 355/260 |
| 5,079,591 | 1/1992 | Tomita et al. | 355/260 |

FOREIGN PATENT DOCUMENTS

| | | |
|---|---|---|
| 59-123670 | 7/1984 | Japan . |
| 59-138461 | 8/1984 | Japan . |

*Primary Examiner*—A. T. Grimley
*Assistant Examiner*—Sandra L. Brasé
*Attorney, Agent, or Firm*—Fitzpatrick, Cella, Harper & Scinto

[57] ABSTRACT

An ink jet recording apparatus is designed to prevent leakage of ink from an ink tank cartridge with recording ink stored therein when the cartridge is removed. A flexible ink bag is sandwiched between an upper plate and a lower plate so that the-upper plate can be moved as the ink bag contracts as the ink is consumed. When the ink is almost gone, the upper plate is held by a latch on the lower plate, and movement of the ink bag is suppressed. Leakage of ink from a stopper that provides access to the ink bag is prevented by sealing members on the upper and lower plates. Thus, when the cartridge is replaced, no ink will be applied.

9 Claims, 4 Drawing Sheets

INK TANK CARTRIDGE THAT PREVENTS LEAKAGE OF RESIDUAL INK AND INK JET RECORDING APPARATUS USING SAME

This application is a continuation of application Ser. No. 07/801,936, filed Dec. 3, 1991, now abandoned.

BACKGROUND OF THE INVENTION

1. Field of the Invention

The present invention relates to an ink tank cartridge and an ink jet recording apparatus using same.

2. Description of the Related Art

In the prior art, there have been proposed recording apparatuses for recording on recording media such as paper or sheets for overhead projectors (hereinafter referred to as recording paper or simply paper), in which recording heads are installed by various recording methods. These recording methods can be either a wire dot, a thermal, a thermal transfer, or an ink jet method. In the ink jet method, for example, recording is performed by directly discharging ink onto recording paper. The running cost is low and this method, which provides virtually noiseless recording, has attracted a great deal of attention lately.

Recording apparatuses using an ink jet method are broadly classified into the following two types: one in which a recording head and an ink supply tank are made into a single unit that can be replaced; and one in which a recording head and an ink supply tank are constructed separately, the ink supply tank producing an ink supply source to compensate for the loss of ink due to recording and being detachably mounted in the main body of the apparatus for replacement by the user.

In the latter type of ink tank, ink is housed in a sealed flexible bag of an aluminum-laminate material or the like to prevent changes in the ink due to irradiation of light, entry of air or other gases that can affect ink supply and leakage of ink to the environment and also to balance the internal pressure of the ink supply system. The ink bag is typically housed in a box-shaped housing for ease of handling of the cartridge into which it is incorporated. A stopper formed of an elastic member, such as rubber, is mounted in the ink bag and a hollow needle member disposed in the ink supply system of the ink jet recording apparatus's main body is inserted through the stopper to supply ink to the recording head.

However, in the ink cartridge described above, a problem sometimes occurs depending upon how a cartridge is handled when it is detached from the apparatus's main body. For example, in a cartridge loaded in the apparatus for a long period of time, a stopper formed of rubber may deteriorate due to aging. In this case, the hole through which the hollow needle member was inserted may not be completely sealed when the cartridge is removed from the apparatus. In this condition, the small amount of ink that has not been completely discharged from the bag can leak from the through hole of the stopper. Hence, the inside of the recording apparatus (particularly the cartridge housing section) and the operator's hands can be soiled when the cartridge is removed from the apparatus. In addition, when the cartridge is disposed of, ink may be undesirably released to the environment. Leakage from the ink bag can be exacerbated initially expanded to almost fully occupy the space inside the housing, but when it contracts as the ink is consumed, it can move inside the housing and cause ink to squirt from the hole of the stopper.

SUMMARY OF THE INVENTION

The present invention has been accomplished to solve the above-mentioned problems of the prior art.

Accordingly, an object of the present invention is to adequately prevent leakage of ink from a discarded cartridge so that no problem is posed to the environment.

In accordance with one aspect of the present invention, an ink tank cartridge, which is capable of serving as an ink supply source for a recording head that records by discharging ink onto a recording medium and which is capable of being loaded on and unloaded from an ink jet recording apparatus, comprises a flexible bag for storing ink, the flexible bag having an ink supply passage that permits entry into the flexible bag of connection means on the apparatus for delivering ink from the flexible bag to the recording head, wherein the flexible bag contracts as ink is delivered therefrom, a displacement member maintained in contact with the contraction thereof, a restriction member for engaging the displacement member to restrict expansion of the flexible bag when substantially all of the ink has been delivered therefrom, for blocking access of any residual ink in the flexible bag to the ink supply passage when the restriction member engages the displacement member.

In accordance with another aspect of the present invention, an ink jet recording apparatus comprises the above ink tank cartridge and a recording head for recording by discharging ink, connection means for delivering ink from the cartridge to the recording head and means for releasably holding the cartridge.

In yet another aspect of the present invention, an ink tank cartridge for storing ink to be supplied to a recording means comprises a flexible ink bag for holding ink, a stopper member disposed in the flexible ink bag for accepting a needle through which ink can be delivered from the flexible ink bag to the recording means, a housing to which the stopper member is mounted, and a sealing member for blocking access of any residual ink in the flexible ink bag to the stopper member when substantially all of the ink in the flexible ink bag has been delivered therefrom.

According to the present invention, when the ink tank cartridge must be replaced and is removed, the ink storage bag is compressed by a displacement member or sealed by a sealing member or both. Therefore, leaking or squirting of ink is prevented.

These and other objects, features and advantages of the present invention will become clear when reference is made to the following description of the preferred embodiments of the present invention, together with reference to the accompanying drawings.

DETAILED DESCRIPTION OF THE PREFERRED EMBODIMENTS

Preferred embodiments of the present invention will be explained below with reference to the accompanying drawings.

Figure 1:
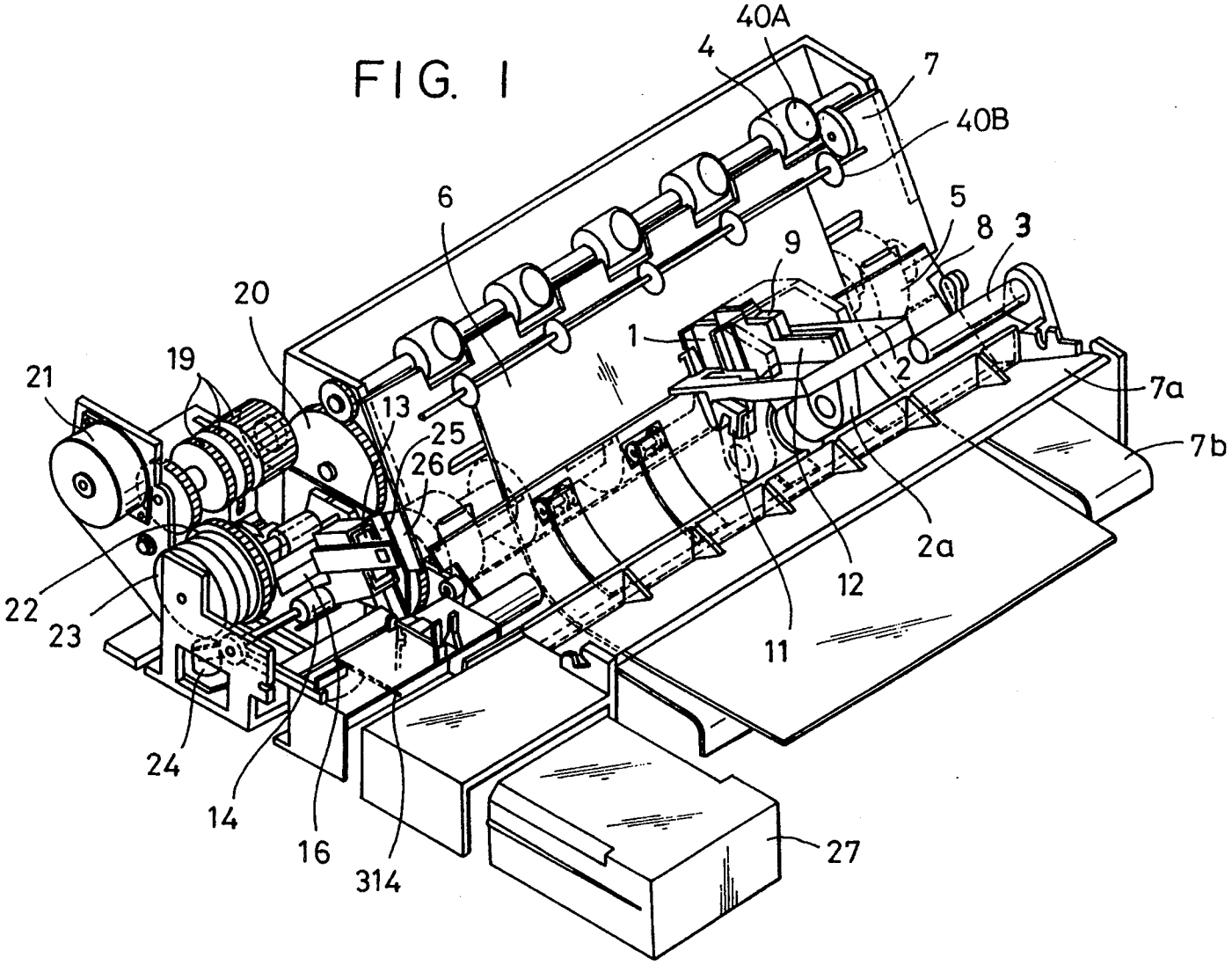
FIG. 1 is a perspective view which illustrates an ink jet recording apparatus in accordance with an embodiment of the present invention.

FIG. 1 is a perspective view which illustrates an ink jet recording apparatus of the present invention. It shows a state in which the top and bottom covers of the apparatus are removed.

Referring to FIG. 1, reference numeral 1 denotes a recording head in the form of a chip; reference numeral 2 denotes a carriage in which the recording head 1 is installed and which enables the recording head 1 to move to perform scanning. Disposed on the carriage 2 are a supporting member for releasably mounting the recording head 1 and a cover member (indicated by a long and short dashed line in the figure) for protecting a board which is a part of the recording head 1 and on which a driving circuit or the like is printed.

The front end of the recording head 1 installed in the ink jet recording apparatus of the present invention has 64 outlets. An ink liquid passage is connected with each outlet and a common liquid chamber for supplying ink to these liquid passages is disposed behind the ink liquid passages. Each passage has therein an electro-thermal converting element for generating thermal energy which causes film boiling of the ink to discharge ink droplets from the outlets and electrode wiring for supplying power to these elements.

These electro-thermal converting elements and the electrode wiring are formed on a board made of silicon or the like by film-forming technology. Furthermore, the outlets, ink liquid passages and common liquid chamber are constructed on this board by laminating partitions, ceilings, etc. made of resin or a glass material. Of course, any of the currently known methods of manufacturing ink jet heads can be used to construct the outlets, ink liquid passages and the common liquid chamber. For example, a ceiling plate with grooves (an orifice plate may be formed as a body separate from the ceiling plate or a piece integral therewith) may be joined to the board on which the electro-thermal converting elements are formed. A driving circuit for driving the electro-thermal converting elements on the basis of recording signals is disposed in the form of a printed board far behind the recording head 1 in such a manner as to be capable of being connected to signal transmission wiring on the apparatus's main body.

A connector board 12 is disposed via a connector 9 (hereinafter referred to as a terminal) behind the recording head 1. The connector 9, which is electrically connected with an electrical connection section of the recording head 1, and a connector for connecting flexible cables from a control circuit of the apparatus's main body, are disposed on the connector board 12. Capacitors, resistors and the like are mounted on the connector board 12. A decrease in the voltage of the power supplied via the flexible cables and noise mixed into the recording signals are compensated by these devices. In the present embodiment, the connector board 12 is supported on a sliding member, as will be described later. The sliding member slides in accordance with the opening/closing operations of the cover member, and the connector 9 is connected to a terminal of the recording head 1.

The carriage 2 engages with a guide shaft 3 for moving the carriage via an engagement section 2a thereof in such a manner as to be capable of sliding and rotating. The length of the carriage guide shaft 3 is longer than the width of a recording paper in such a manner as to intersect the direction in which a recording medium, such as recording paper, is transported. The carriage 2 is connected to a part of an unillustrated belt extending parallel to the guide shaft 3. The movement of the carriage 2 along the guide shaft 3, namely, the movement of the recording head 1 to perform scanning, is made possible by the belt being driven by an unillustrated carriage motor. The carriage 2 and the guide shaft 3 obtain a force for rotation around the guide shaft 3 due to their own weights. By using this rotating force as an energization force, a paper pressing plate 8 to be described later is energized via a sliding member, disposed on the carriage 2, which slides on the paper pressing plate. As a result, it is possible for the recording head 1 to be spaced apart by a predetermined space between it and the recording paper according to the thickness of the recording paper used.

A recording paper 6 fed by an unillustrated paper feed cassette or by hand is introduced to the apparatus's main body via a paper feed port formed by a paper upper guide 7a and a paper lower guide 7b. The paper pressing plate 8 having a curvature is contiguous to the paper upper guide 7a along a side thereof. The paper pressing plate 8 is disposed so as to press the recording paper against paper feeding rollers 5. The plate 8 is formed of a material such that a frictional force produced between the paper pressing plate 8 and the recording paper during this pressing operation is smaller than that produced between the paper feeding rollers 5 and the recording paper. The paper lower guide 7b extends to a position where the paper feeding rollers 5 are disposed parallel to the paper pressing plate 8.

As a result of the above, the recording paper 6 fed from the paper feed port is transported line by line in accordance with the rotation of the paper feeding rollers 5. At this time, the recording paper 6 slides on a plate-like platen 7 while the space between the paper pressing plate 8 and the platen 7 is restricted to a predetermined size.

The recording head 1 performs recording of one line of data, by discharging ink droplets to an area where the recording paper 6 is to be recorded, in accordance with the scanning movement of the carriage. Thus, recording is performed sequentially line by line by the above recording and the transporting of one line of the recording paper. As a result, characters, images and the like are formed. The recorded recording paper 6 is then ejected onto an unillustrated paper eject tray by means of paper eject rollers 4 disposed above a recording paper feeding passage and spurs 40A and 40B in accordance with the transporting thereof. Five pairs of the spurs 40A and 40B are disposed in correspondence with the paper eject rollers 4. A spur cleaner is interposed between the spurs in each pair of spurs. Neither the spur cleaner nor a member for supporting the spur cleaner are illustrated in FIG. 1. The spur 40A applies a pressing force to the paper eject rollers 4 via the recording paper. The spur 40B regulates the recording paper feeding passage between it and the platen 7. The paper eject rollers 4 are rotatably driven so that the peripheral speed thereof becomes greater than that of the paper feeding rollers 5. As a result, that part of the recording paper 6 constituting a recording area is pulled upward. Thus, any defects in the recording area, such as a separating of the recording paper 6 from the platen 7, can be avoided.

A series of components for a discharge recovery process are disposed in the vicinity of a home position in an area other than the recording area, that is, the area scanned by the recording head 1. These components include a blade 26 used to remove by wiping ink droplets (mist, etc.), dust and dirt, etc. on the surfaces of the outlets of the recording head, an absorbing member 25 for removing water droplets on the surface of the outlets chiefly by absorbing them, and a cap 13 for sealing surfaces of the outlets, for receiving ink ejected in an idle discharging operation for maintaining an ink discharging state, for sucking ink from the outlets, and the like. These components are each formed so as to be capable of moving forward or backward with respect to the recording head 1 movement, and for that purpose they are supported together on a movement supporting member 14. In addition, each of these components performs its respective operations at proper timings. The sucking of ink into the cap 13 is performed by means of a pump 24 which is connected to the cap 13 via a tube and a hollow section of the movement supporting member 14. The sucked-in ink is collected by a waste ink collector. In this embodiment, ink is collected into the ink tank cartridge. When capping is performed by the cap 13, the recording head 1 is blocked from rotating backward by the engagement of a hole formed in a cap arm 17 mounted on the side of a holding member of the cap 13 with a projection disposed on the carriage 2. As a consequence, capping of the surfaces of the outlets can be performed reliably.

Respective rotations of the paper feeding rollers 5 and the paper eject rollers 4, operations of the discharge recovery mechanism, that is, forward and backward movement as one piece of the cap 13, the blade 26 and the absorbing member 25, and a sucking operation by the pump 24, are performed by using the rotational driving force of a feeding motor 21. That is, the rotational driving force of the feeding motor 21 mounted in a part of a frame of the apparatus's main body is first transmitted to a transmission switching gear train 19. Each gear is selected by the operation of the carriage 2, that is, scanning movement and movement to the home position and the discharge recovery apparatus by the recording head 1, and by the movement of selection gears (not shown) in linkage with various operations, such as stop operations, at these positions. As a result, the rotational force of each gear in the gear train 19 is transmitted via an intermediate gear 20 to the paper feeding rollers 5 and the paper eject rollers 4. The rotational force is also transmitted finally to the integral cap 13, etc. via a cam 16. Furthermore, this force is transmitted via a pump gear 22 and a pump cam 23 to the pump 24.

The ink is delivered from an ink tank cartridge 27, installed in the apparatus's main body, to the recording head 1 via a hollow needle 314, which is inserted through a stopper of the ink cartridge 27 and enters an ink bag, and a flexible tube capable of following the movement of the carriage 2. The position to which the carriage 2 has moved can be detected by counting the number of steps of a carriage motor with the position of the engagement of a home position sensor 11, disposed on the carriage 2 with a flag, for detecting a home position, disposed in the vicinity of the end of an area where the carriage 2 moves, as a reference.

Figure 2:
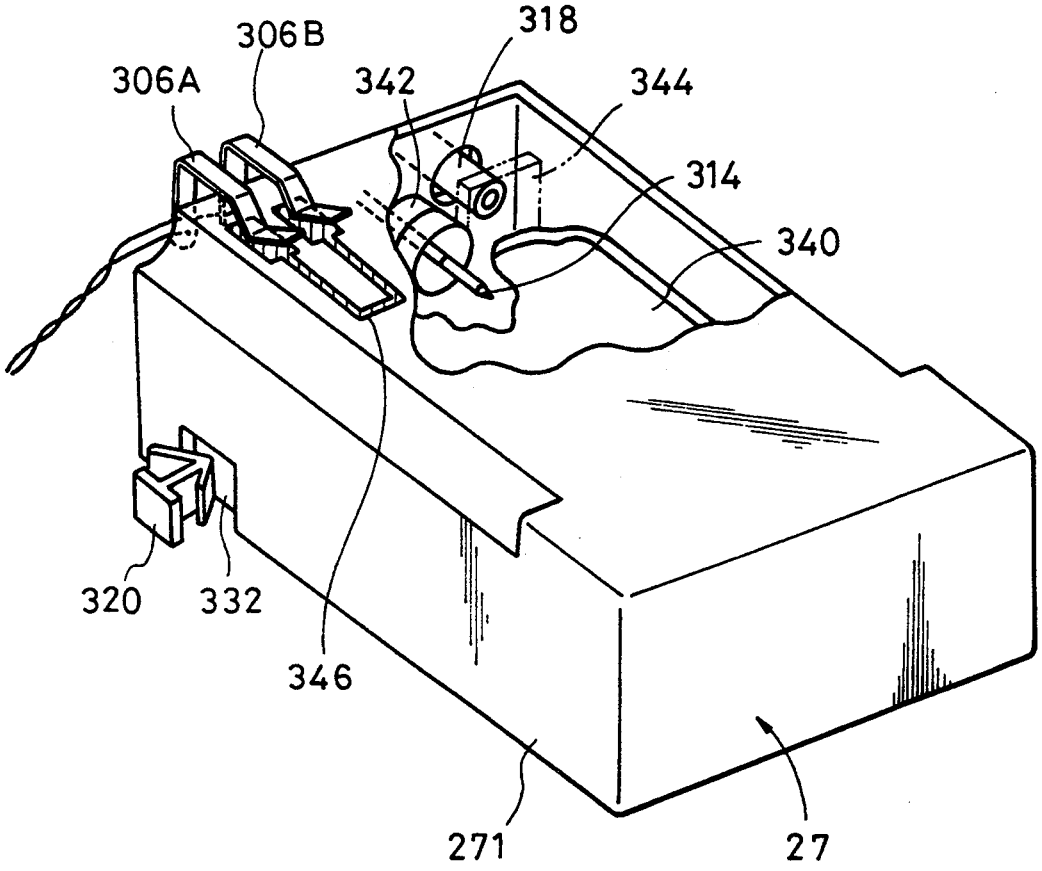
FIG. 2 is a perspective view which illustrates the section where the ink tank cartridge of FIG. 1 is mounted.

FIG. 2 is a view which illustrates an ink tank cartridge 27 and sections which are connected to the apparatus's main body. In FIG. 2, reference numeral 271 denotes a cartridge housing; reference numeral 340 denotes a flexible ink bag storing ink to be delivered to the recording head, a rubber stopper 342 being mounted to the housing 271 in a section where the ink bag is to be connected with the ink supply needle 314 of the main body. The needle 314 is inserted through the stopper 342 and extends well into the ink bag 340, with the result that ink can be delivered to the recording head 1 through the ink supply passage provided by the stopper. Reference numeral 344 denotes an ink absorber for accepting waste ink produced by operation of the above-described discharge recovery mechanism via a waste ink pipe 318 from the cap of 13. The ink absorber 344 is contiguous to an ink absorber disposed in a lower section of the ink bag. As a consequence, waste ink can be collected satisfactorily. Since waste ink is collected by the ink tank cartridge in this way, the ink absorber is replaced when the cartridge is replaced, that is, when the ink inside the ink bag is completely discharged, and thus the collection of waste ink is started again.

Reference numeral 346 denotes a wiring pattern provided on the top surface of the ink cartridge 27. The control section of the apparatus's main body can detect whether an ink cartridge is installed according to whether a section between contact points 306A and 306B having this wiring pattern 346 therebetween is conducting or non-conducting. The control section of the main body can read data information by making this pattern a resistance pattern having a resistance value determined according to the color, density, etc. of the ink in the cartridge. The control section allows the recording head to be driven properly to perform excellent image recording.

Reference numeral 320 denotes a click member employed as a fastener for the ink cartridge 27. One click member is disposed on each respective side of the cartridge housing section of the apparatus's main body. This click member 320 permits the ink cartridge 27 to be inserted or removed by elastic flexing of the click member when the ink cartridge 27 is inserted or removed. The click member holds the ink cartridge 27 in place by returning to its original shape when it is positioned in a recessed section 322 of the ink cartridge 27. A projection for opening a safety lid (not shown) disposed in a cartridge-loaded section of the apparatus's main body may also be provided on the ink tank cartridge.

Figure 3:
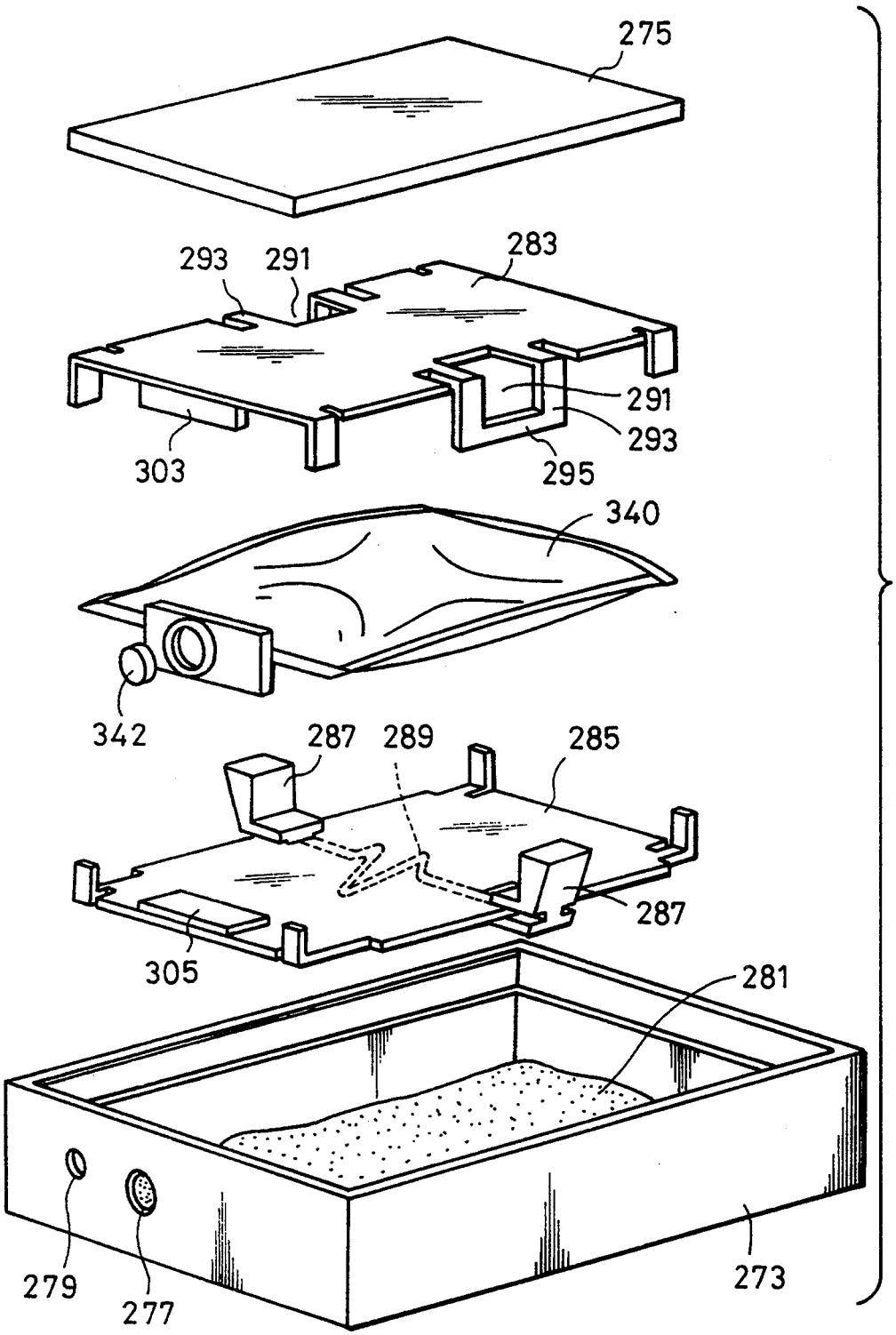
FIG. 3 is an exploded perspective view which illustrates in detail the ink tank cartridge of FIG. 1.

FIG. 3 is an exploded perspective view which illustrates an ink cartridge of the present embodiment. In FIG. 3, reference numeral 273 denotes a housing main body, and reference numeral 275 denotes a horizontal lid of the housing. These members form the cartridge housing 271. The housing main body 273 is provided with holes 277 and 279 for mounting the stopper 342 and permitting the entry of the hollow needle 314 and for permitting entry of the waste ink pipe 318, respectively. These holes thus permit the stopper 342 and the ink absorber 344 to engage with the hollow needle 314 and the waste ink pipe 318, respectively. An ink absorber 281 contiguous to the ink absorber 344 is disposed on the bottom surface of the housing main body 273, and waste ink is introduced thereinto. This ink absorber 281 may be disposed as shown on the bottom surface of the housing main body 273, or it may be disposed in a section divided by a partition or the like from the space above it.

The ink bag 340 is housed in a space inside the cartridge formed by the housing main body 273 and the horizontal lid 275. In the present embodiment, the ink bag 340 is disposed between an upper plate 283 and a lower plate member 285. The upper first plate member 283 and the lower second plate 285 should preferably be bonded to the ink bag 340 by a double-sided bonding tape, a bonding agent or the like. From the viewpoint of preventing the ink bag 340 from moving around in the space inside the cartridge, it is desirable that the lower plate member 285 be secured to the housing main body 273 by means of a screw, a bonding agent, a double-sided bonding tape, etc.

At least a pair of claw-like block members 287 are slidably disposed in at least one side edge in the lower plate 285. The pair of block members 287 are forced to move outwardly, that is, apart or away from each other, by a compression spring 289 disposed on the rear surface of the lower plate 285, to which compression spring 289 the pair of claw members 287 are connected. An engagement piece 293 provided with an opening 291 for permitting the block members 287 to pass through is disposed in an upright manner on the upper plate 283, at a position corresponding to that of the block members 287.

Figure 4A:
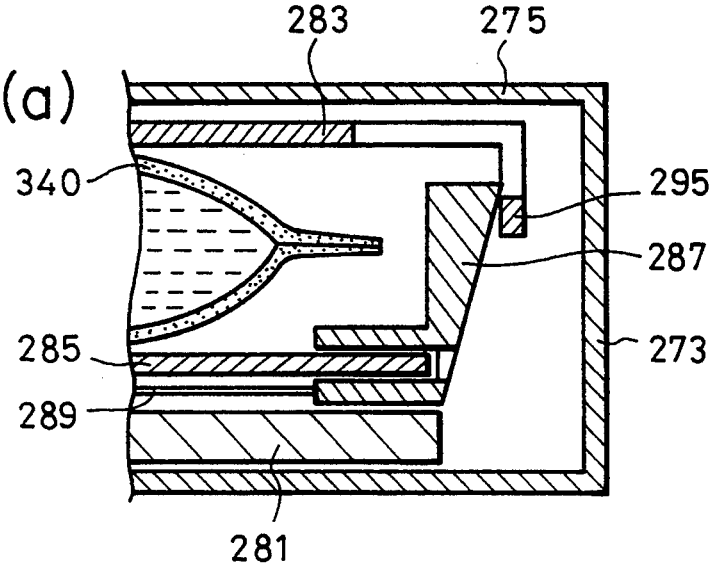
FIGS. 4(*a*), 4(*b*) and 4(*c*) are views for showing the operation of the ink tank cartridge of this embodiment.
Figure 4B:
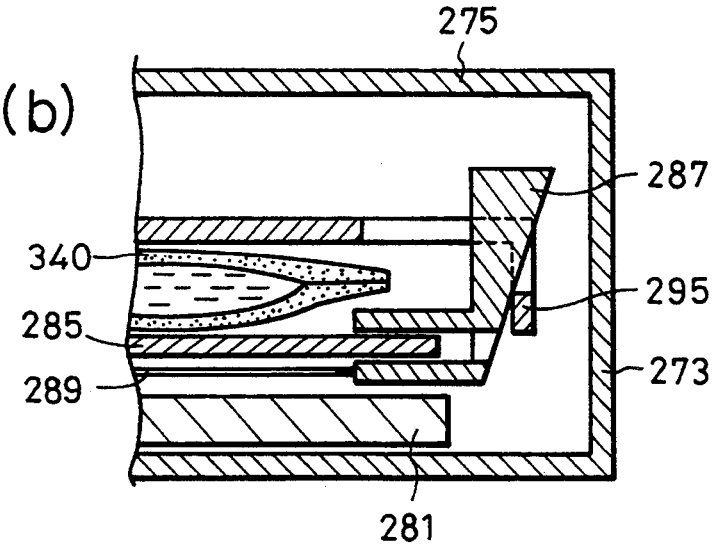
Figure 4C:
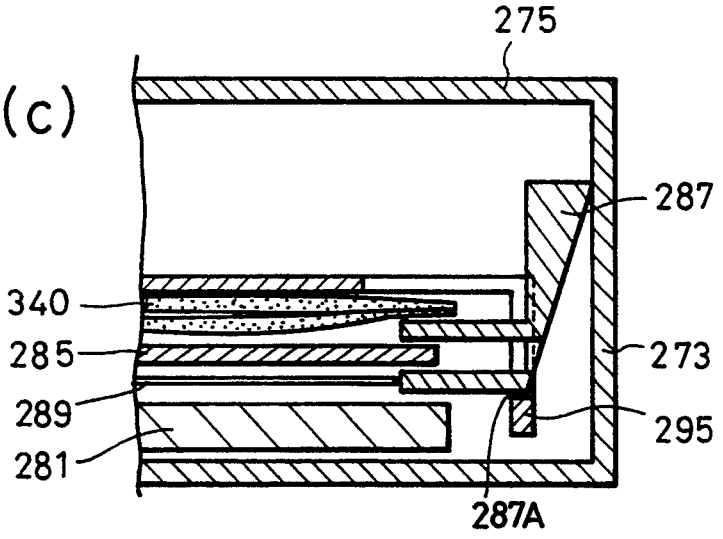

In a state in which the ink bag 340 is sufficiently filled with ink and it is in an expanded state, as shown in FIG. 4(*a*), the block members 287 are prevented from moving outwardly by an engagement section 295 on each engagement piece 293. The upper plate 283 changes its position and moves downward to maintain contact with the ink bag in response to the contraction of the ink bag 340 as the ink is consumed, as shown in FIG. 4(*b*). When the amount of the remaining ink becomes very small, that is, when substantially all of the ink in the ink bag has been consumed, the block members 287 relatively pass the opening 291 and are projected outwardly by the energization force of the spring 289 when the engagement thereof with the engagement piece 295 is released, as shown in FIG. 4(*c*). In this state, even if a force by which the ink bag is expanded, that is, a force by which the upper plate 283 is made to rise, is applied, the engagement section 295 of the engagement piece 293 is brought into abutment with a bottom surface 287A of the block members 287, thus forming a latching mechanism to prevent the rise of the upper plate 283. Since the lower plate 285 is fixed to the cartridge housing 271, the moving around of the ink bag inside the cartridge housing 271 is restricted by the engagement of the lower plate 285 and the upper plate 283 with the ink bag between them. Thus, the danger decreases that ink will leak from a hole formed in the stopper 342 through the needle 314 after the needle is removed. Of course, the function of preventing leakage of ink is achieved even if the upper plate 283 and the lower plate 284 are both movable.

In the present embodiment, the outside surface of each block member 287 is formed as an inwardly inclined sloping surface, which provides a camming surface for the upper plate 283. That is, the outward force exerted on the block members 287 by the spring 289 functions as a force acting downwardly on the engagement piece 293 to urge the first and second plates together. Thus, the first plate 283 satisfactorily responds to the contraction of the ink bag due to the consumption of the ink. The camming action of the inclined surface provides a downward force that slightly compresses the ink bag, thereby making it possible to satisfactorily supply ink from the ink bag even when the amount of the remaining ink is small.

Leakage of ink can be still more effectively prevented by adopting the construction described below. In FIG. 3, reference numerals 303 and 305 together denote a sealing member and are disposed on the upper plate 283 and the lower plate 285, respectively. They do not engage with each other because the ink bag 340 is full of ink sufficient for use, as shown in FIG. 4(*a*). In the condition shown in FIG. 4(*c*), however, the members 303 and 305 are brought into contact with each other with the ink bag 340 between them. The members 303 and 305 satisfactorily sandwich the ink bag 340 from both sides thereof and from the top and bottom sections thereof and engage with each other in a state in which the ink bag 340 is collapsed, to block access of any residual ink to the stopper 342 when the latching mechanism engages the upper plate 283.

The closer the members are disposed to the stopper 342, the better. The sealing members can be positioned close to where the tip of the needle 314 is positioned or at an area where the needle is when the ink cartridge 27 is loaded. In the latter case, since the member 303 interferes with the needle 314 as the ink is used, it is desirable that the upper plate 283 be capable of being inclined with respect to the lower plate 285 or that the sealing member 303 be flexible so that the downward movement of the upper plate 283 is not obstructed. When the ink cartridge 27 is removed, and the needle is thus retracted, the member 303 engages with the member 305 with the ink bag 340 between them because the cartridge 27 loses the support by the needle 314.

When the stopper 342 is hollow, the needle 314 stops at that position, and ink is supplied through the hollow section. Ink leakage can be satisfactorily prevented by sealing the boundary between the stopper 342 and the ink bag 340 by means of the members 303 and 305. At least one of these members 303 and 305 may be formed by an elastic member, such as rubber, when the shut-off of the ink supply passage by the close contact of the upper and lower sections of the ink bag 340 is taken into consideration. If such a consideration is not necessary, both the members 303 and 305 may be formed as integrally bent sections on the upper plate 283 and the lower plate 285.

If there is a spatial margin in front of the stopper 342 inside the housing 27, instead of compressing the ink bag 340 by the members 303 and 305, for example, a flat plate similar to the member 303 may be disposed in a section corresponding to the front section of the stopper 342 on the upper plate so that the front section of the stopper 342 is sealed by the flat plate member in the condition shown in FIG. 4(*c*). In this case, it is necessary that the member itself be formed of a material having an ink sealing or absorbing property and that such material be disposed on the surface where the member is joined with the stopper 342. In this case also, because the member can interfere with the needle 314, the above-described construction in which the downward movement of the upper plate 283 is not blocked should preferably be adopted.

With the construction described above, even if the hole formed by insertion of the needle 314 is not completely sealed because the stopper 342 formed of rubber or the like deteriorates due to aging, or when cracks are caused due to the deterioration of the stopper 342 although the through hole is sealed, leakage of residual ink from the ink cartridge, which is removed because of the shut-out of the ink passage to the outside, can be satisfactorily prevented.

Needless to say, various constructions can be used in the present invention without being limited to the one described above.

Although in the above-described embodiment the upward movement of the upper plate 283 is not restricted by the block members 287 and the engagement piece 295 until the amount of remaining ink is very small, a ratchet mechanism which engages with the upper plate 283 and the lower plate 285 may be disposed so that upward movement of the upper plate 283 is always restricted, even before the ink is used up. As a result of the above, since the upper plate 283 will not move upward even by the influence of vibrations or the like when the cartridge is loaded, inconveniences, such as air intake from the ink outlets of the recording head because a negative pressure acts on the ink supply system, will not occur.

If an adverse affect is exerted upon the needle 314, or upon a member for supporting the needle and the like due to the above-described function of the member 303 for blocking the access of ink to the needle 314, a member for supporting the member 303 may be disposed on the main body during loading to sandwich the ink flow-out section when the ink cartridge is removed.

Furthermore, the member forming the lower plate 285 may be integral with the housing main body 273. In addition, if there is a danger that the upper plate 283 can move far downward in the condition shown in FIG. 4(*c*), causing the remaining ink to be pushed out, a member for restricting the further downward movement of the upper plate 283 from the state of FIG. 4(*c*) may be disposed.

Although the present embodiment is effective when a completely discharged ink cartridge is discarded, because the cartridge can be disposed of in consideration of the current contaminated state of the earth's environment. Also, cartridges can be satisfactorily collected without contaminating the environment because leakage of ink can be prevented.

Cooperating engagement members may be disposed on the housing main body and on the housing lid in order that the cartridge housing main body 273 and the housing lid 275 can be separated, with the result that an ink bag in a collected cartridge from which ink has been completely discharged, and an ink absorber for collecting ink, can be easily replaced. Thus, ink cartridges can be reused, and effective use of resources is made possible.

The present invention comprises a means (e.g., electrothermal converters, laser beam, etc.) for generating thermal energy used to cause ink to be discharged, and brings about notable advantages in thermal heads and recording apparatuses of a system which transforms the condition of the ink by thermal energy so that high density and resolution can be achieved.

The basic principles disclosed, for example, in U.S. Pat. Nos. 4,723,129 and 4,740,796, should preferably be used for a typical construction of the present invention. This system can be applied to any of so-called on-demand and continuous types. In the case of the on-demand type, particularly, thermal energy is generated in an electro-thermal converter by applying thereto at least one driving signal corresponding to recording data in order to eject liquid (ink) onto a sheet. The signal gives rise to a sharp increase in the temperature of ink exceeding the film boiling point, with the result that vapor bubbles can be formed in the liquid (ink) in a one-to-one correspondence with this driving signal. At least one droplet is formed by discharging liquid (ink) via a discharge opening by the growth and contraction of these vapor bubbles. If these driving signals are pulsated, the bubbles grow and contract instantaneously, the liquid (ink) can be discharged in response to high frequency driving signals. As regards driving signals in the form of pulses, those disclosed in U.S. Pat. Nos. 4,463,359 and 4,345,262 are preferable. If conditions are used which are described in U.S. Pat. No. 4,313,124, which relates to the rate of temperature increase on the thermal working surface of the electro-thermal converter, much better recording can be performed.

Regarding the recording head, U.S. Pat. Nos. 4,558,333 and 4,459,600 disclose a construction in which a thermal working surface is placed in a bent area. In addition, this invention covers a construction (a straight-line liquid path or a right-angle liquid path) in which outlets, liquid passages and electro-thermal converters are combined. Also, the present invention is effective for a construction based on Japanese Patent Laid-Open No. 59-123670, which discloses a construction in which a common slit is made as an outlet for a plurality of electro-thermal converters, or Japanese Patent Laid-Open No. 59-138461, which discloses a construction in which an opening which absorbs pressure waves of thermal energy is used as an outlet. According to the present invention, recording can be performed reliably and efficiently regardless of the shape of the recording head.

In addition, the present invention can be effectively applied to a full-line type recording head having a length corresponding to the maximum width of a recording medium which can be printed by the recording apparatus. Such a recording head may be made in such a length by combining a plurality of recording heads or may be a single recording head formed into one piece.

The present invention can be effectively applied to cases in which a recording head is fixed to the apparatus's main body, a replaceable chip-type recording head by which an electrical connection with the apparatus's main body and the supply of ink from the apparatus's main body are made possible by such a chip-type recording head being loaded into the apparatus's main body, or a cartridge-type recording head in which an ink tank is integrally disposed, although the head in the latter case will be a serial type as described above.

A recovery means, preparatory auxiliary means or the like, which are disposed as components of the recording apparatus of the present invention, can preferably be added to the recording head, by which addition the effect of the present invention can be enhanced. Other additions may include cleaning means, pressurizing means, or electrothermal converters or heating elements other than the ink-ejecting converters, or a preparatory heating means which uses a combination of the above. Preparatory discharge of ink prior to recording is also effective for stabilizing recording.

As regards the types and numbers of recording heads to be installed, not only one recording head may be used for ink of a single color, but also a plurality of recording heads corresponding to a plurality of inks of different colors and densities may be used. In addition to performing a recording mode using a main color, such as black, the recording head may be integrally formed or formed of a combination of a plurality of devices. The present invention is very effective as an apparatus that can record in a plurality of different colors or full colors by color mixture.

In addition, the ink jet recording apparatus of the present invention can be used as image output terminals of information processing apparatuses, such as computers, copiers combined with a reader or the like, or facsimile apparatuses having a transmitting/receiving function.

As has been explained above, according to the present invention, leakage of ink from a used cartridge can be prevented. The problem of environmental disruption caused by ink can be solved.

Many different embodiments of the present invention may be constructed without departing from the spirit and scope of the present invention. It should be understood that the present invention is not limited to the specific embodiments described in this specification, and is only limited in the appended claims.

What is claimed is:

1. An ink tank cartridge capable of serving as an ink supply source for a recording head that records by discharging ink onto a recording medium and of being loaded on and unloaded from an ink jet recording apparatus, the ink tank cartridge comprising:

a flexible bag member for storing ink, said flexible bag member having an ink supply passage that permits entry into said flexible bag of connection means on the apparatus for delivering ink from said flexible bag to the recording head, wherein said flexible bag contracts as ink is delivered therefrom;

a displacement member maintained in contact with said flexible bag for displacing in accordance with the contraction thereof;

a restriction member for engaging said displacement member to restrict expansion of said flexible bag when substantially all of the ink has been delivered therefrom; and a sealing member, disposed on said displacement member, for sealing said ink supply passage in order to prevent any residual ink in said flexible bag from being discharged, by engaging and compressing a part of said ink supply passage.

2. An ink tank cartridge according to claim 1, wherein said displacement member includes a first plate member and said restriction member includes a pair of engagement members disposed on opposite sides of a second plate member facing said first plate member for engaging opposite sides of said first plate member to compress said flexible bag between said first and second plate members.

3. An ink tank cartridge according to claim 2, further comprising a cartridge housing, wherein said second plate member is secured to said housing.

4. An ink tank cartridge according to claim 2, wherein each said engagement member includes a camming surface for cooperating with said first plate member to urge said first and second plate members together.

5. An ink tank cartridge according to claim 4, wherein each said engagement member further includes a latch mechanism for cooperating with said first plate member to prevent movement of said first and second members away from each other.

6. An ink tank cartridge according to claim 5, wherein each said engagement member comprises a block member movably mounted on said second plate member and urging means for urging said blocks apart, each said camming surface including an inclined outer surface on one of said block members that engages an edge of said first plate member.

7. An ink tank cartridge according to claim 6, wherein said latching mechanism includes a bottom surface at an end of said outer surface for engaging a surface of said first plate member.

8. An ink tank cartridge according to claim 2, wherein said sealing member includes separate members on said first and second plate members for clamping said flexible bag between said separate members at said ink supply path.

9. An ink tank cartridge for storing ink to be supplied to recording means, the ink tank cartridge comprising:

a flexible ink bag for holding ink;

a stopper member disposed in said flexible ink bag for accepting a needle through which ink can be delivered from said flexible ink bag to the recording means;

a housing to which said stopper member is mounted; and a sealing member for sealing said flexible ink bag to block access of any residual ink in said flexible ink bag to said stopper member when substantially all of the ink in said flexible ink bag has been delivered therefrom, wherein said sealing member clamps said flexible ink bag proximate to said stopper member.

* * * * *

UNITED STATES PATENT AND TRADEMARK OFFICE

CERTIFICATE OF CORRECTION

PATENT NO. : 5,400,066

DATED : March 21, 1995

INVENTORS : HARUYUKI MATSUMOTO, ET AL.

It is certified that error appears in the above-identified patent and that said Letters Patent is hereby corrected as shown below:

ON THE TITLE PAGE

At [57] Abstract

Line 5, "the-upper" should read --the upper--.

COLUMN 1

Line 66, "exacerbated" should read --exacerbated because although being--.
Line 67, "but" should be deleted.

COLUMN 6

Line 16, "of" should be deleted.

COLUMN 7

Line 55, "284" should read --285--.

UNITED STATES PATENT AND TRADEMARK OFFICE

CERTIFICATE OF CORRECTION

PATENT NO. : 5,400,066

DATED : March 21, 1995

INVENTORS : HARUYUKI MATSUMOTO, ET AL.

It is certified that error appears in the above-identified patent and that said Letters Patent is hereby corrected as shown below:

COLUMN 9

Line 20, "affect" should read --effect--.

COLUMN 12

Line 15, "members" should read --plate members--.

Signed and Sealed this

First Day of August, 1995

Bruce Lehman

*Attest:*

BRUCE LEHMAN

*Attesting Officer*

*Commissioner of Patents and Trademarks*